US005431541A

United States Patent [19]

Shaffer

[11] Patent Number: 5,431,541

[45] Date of Patent: Jul. 11, 1995

[54] CERAMIC BLADE ATTACHMENT SYSTEM

[75] Inventor: James E. Shaffer, Maitland, Fla.

[73] Assignee: Solar Turbines Incorporated, San Diego, Calif.

[21] Appl. No.: 159,094

[22] Filed: Nov. 29, 1993

[51] Int. Cl.[6] ..... F01D 5/30

[52] U.S. Cl. ..... 416/215; 416/214 R; 416/205

[58] Field of Search ..... 416/205, 206, 207, 214 A, 416/215

[56] References Cited

U.S. PATENT DOCUMENTS

| | | | |
|---|---|---|---|
| 3,490,537 | 1/1970 | Quenneville | 416/205 |
| 4,717,312 | 1/1988 | Seeley | 416/205 |
| 4,850,801 | 7/1989 | Valentine | 416/205 |
| 5,118,256 | 6/1992 | Violette et al. | 416/205 |

FOREIGN PATENT DOCUMENTS

| | | | |
|---|---|---|---|
| 0821543 | 12/1937 | France | 416/205 |

*Primary Examiner*—Edward K. Look
*Assistant Examiner*—Mark Sgantzos
*Attorney, Agent, or Firm*—Larry G. Cain

[57] ABSTRACT

A turbine blade having a preestablished rate of thermal expansion is attached to a turbine disc having a preestablished rate of thermal expansion being greater than the preestablished rate of thermal expansion of the turbine blade and forms a turbine assembly. The turbine blade has a root portion defining a pair of sides having a pair of grooves therein. The turbine assembly includes a pair of flanges between which the turbine blades are positioned. Each of the pair of flanges has a plurality of grooves defined therein. The grooves within the pair of flanges are aligned with the grooves in the blades and have a space formed therebetween. A plurality of spherical balls are positioned within the space. The plurality of spherical balls has a preestablished rate of thermal expansion being equal to the preestablished rate of thermal expansion of the turbine blade.

9 Claims, 4 Drawing Sheets

CERAMIC BLADE ATTACHMENT SYSTEM

BACKGROUND ART

"The Government of the United States of America has rights in this invention pursuant to Contract No. DE-AC02-92CE40960 awarded by the U.S. Department of Energy"

TECHNICAL FIELD

This invention relates generally to a gas turbine engine and more particularly to a turbine wheel assembly and the joint between a ceramic blade and a turbine wheel.

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

In order to produce a driving torque, the axial turbine consists of one or more stages, each employing one row of stationary nozzle guide vanes and one row of moving blades mounted on a turbine disc. The nozzle guide vanes are aerodynamically designed to direct incoming gas from the combustion stage onto the turbine blades and thereby transfer kinetic energy to the blades.

The gases typically entering the turbine have an entry temperature from 850 degrees to at least 1200 degrees Fahrenheit. Since the efficiency and work output of the turbine engine are related to the entry temperature of the incoming gases, there is a trend in gas turbine engine technology to increase the gas temperature. A consequence of this is that the materials of which the blades and vanes are made assume ever-increasing importance with a view to resisting the effects of elevated temperature.

Historically, nozzle guide vanes and blades have been made of metals such as high temperature steels and, more recently, nickel alloys, and it has been found necessary to provide internal cooling passages in order to prevent melting. It has been found that ceramic coatings can enhance the heat resistance of nozzle guide vanes and blades. In specialized applications, nozzle guide vanes and blades are being made entirely of ceramic, thus, imparting resistance to even higher gas entry temperatures.

However, if the nozzle guide vanes and/or blades are made of ceramic, which have a different chemical composition, physical property and coefficient of thermal expansion to that of a metal supporting structure, then undesirable stresses, a portion of which are thermal stresses, will be set up between the nozzle guide vanes and/or blades and their supports when the engine is operating. Such undesirable thermal stresses cannot adequately be contained by cooling.

Furthermore, conventional joints between blades and discs have typically used a fir tree attachment, or root design. Historically a dovetail root design has been used with a ceramic blade in which a metallic compliant layer of material between the highly stressed ceramic blade root and the metallic turbine disc to accommodate the relative movement, sliding friction, that occurs. The sliding friction between the ceramic blade and the metallic disc creates a contact tensile stress on the ceramic that degrades the surface. This degradation in the surface of the ceramic occurs in a tensile stress zone of the blade root, therefore, when a surface flaw is generated in the ceramic of critical size, the blade root will fail catastrophically.

The present invention is directed to overcome one or more of the problems as set forth above.

DISCLOSURE OF THE INVENTION

In one aspect of the invention, a turbine assembly is comprised of a turbine disc and a pair of flanges attached to the disc. Each of the pair of flanges define an inner surface having a plurality of grooves positioned therein. A plurality of blades are attached within the flanges and each of the plurality of blades have a root portion generally confined within the pair of flanges. The root portion has a pair of sides having a pair of grooves defined therein. The grooves within the blades are aligned with respective ones of the plurality of grooves within the flanges and define a space therebetween. A plurality of spherical balls are positioned within the space between the grooves within the flanges and the grooves within the blades.

BEST MODE FOR CARRYING OUT THE INVENTION

Figure 1:
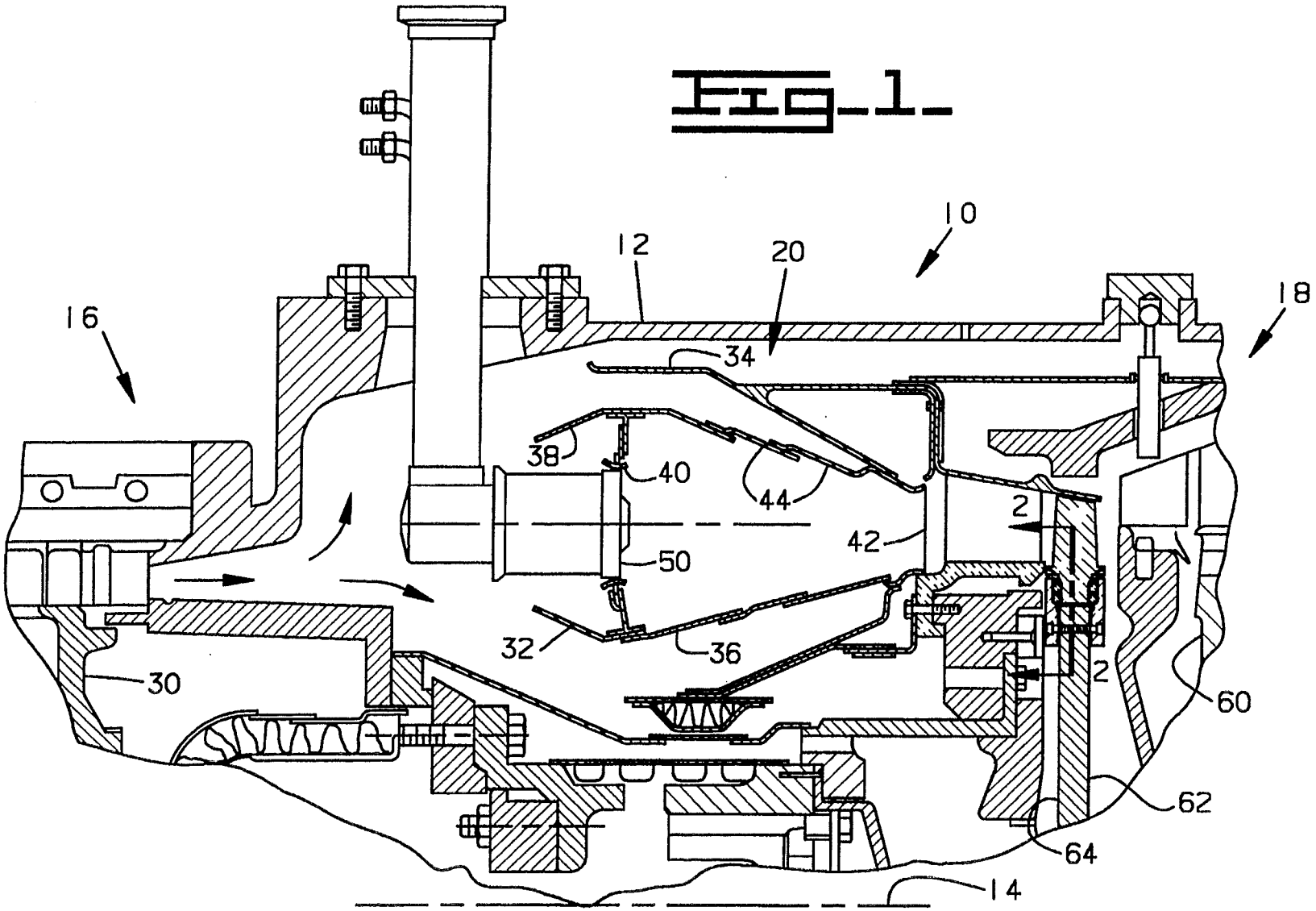
FIG. 1 is a partial side view of a gas turbine engine embodying the present invention with portions shown in section for illustration convenience.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16, which in this application includes an axial staged compressor 30 or, as an alternative, a radial compressor or any source for producing compressed air, causes a flow of compressed air which has at least a part thereof communicated to the combustor section 20. The combustor section 20, in this application, includes an annular combustor 32. The combustor 32 has a generally cylindrical outer shell 34 being coaxially positioned about the central axis 14, a generally cylindrical inner shell 36, an inlet end 38 having a plurality of generally evenly spaced openings 40 therein and an outlet end 42. In this application, the combustor 32 is constructed of a plurality of generally conical segments 44. Each of the openings 40 has an injector 50 positioned therein. As an alternative to the annular combustor 32, a plurality of can type combustors could be incorporated without changing the essence of the invention.

Figure 2:
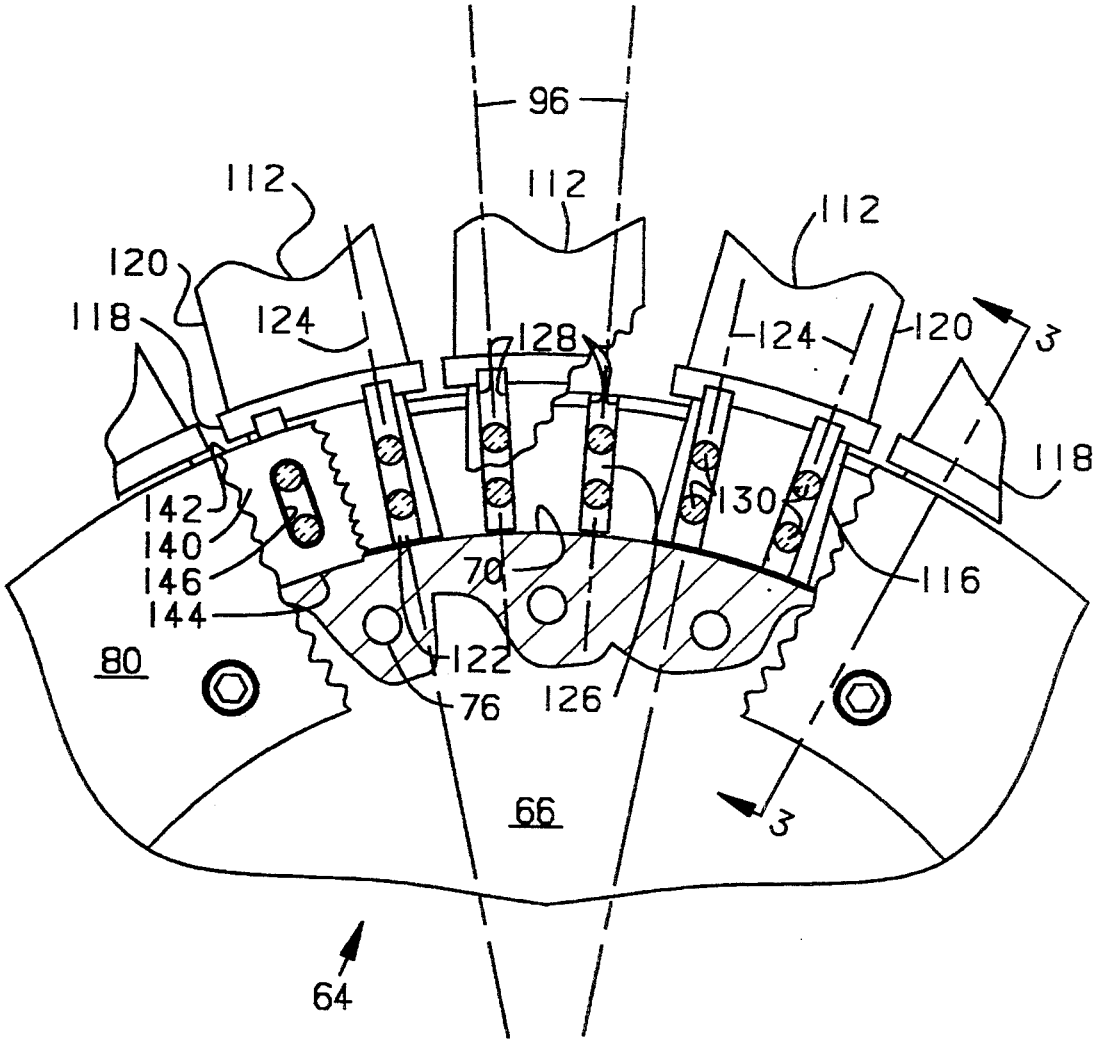
FIG. 2 is an enlarged sectional view of a joint between a ceramic blade and a disc taken along line 2—2 of FIG. 1.
Figure 3:
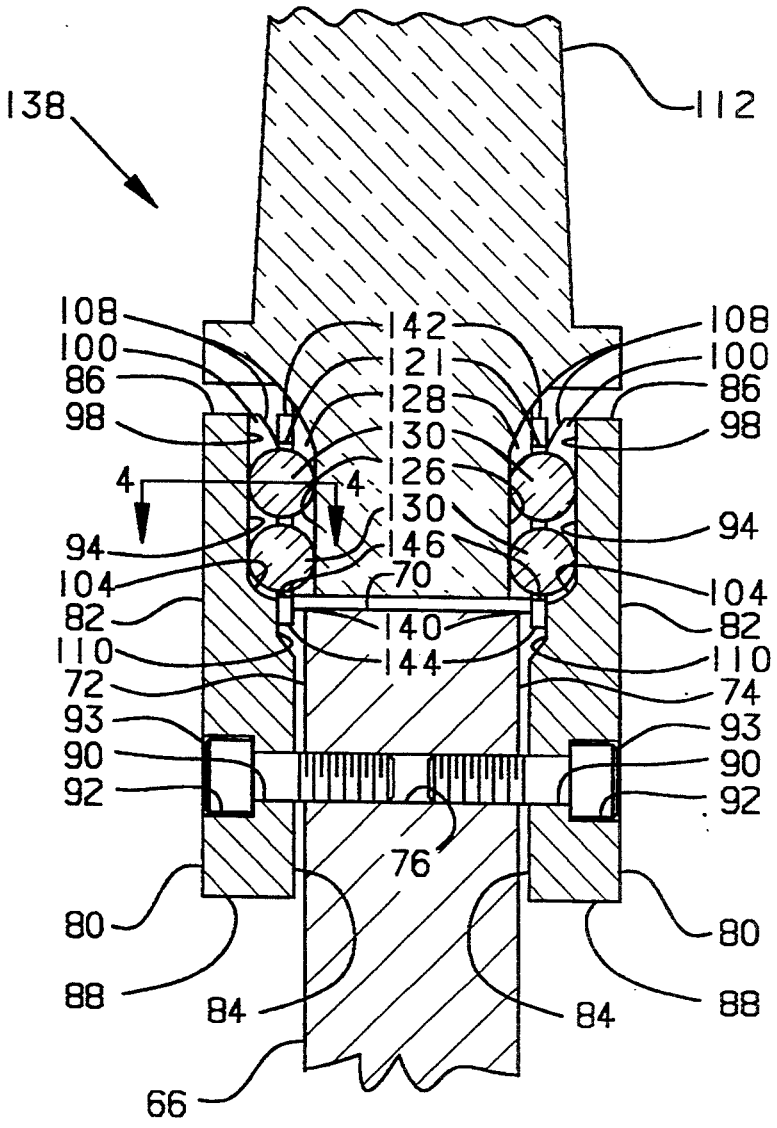
FIG. 3 is an enlarged elevational partially sectional view of the interface of the ceramic blade and the disc embodying the present invention taken along line 3—3 of FIG. 2.
Figure 4:
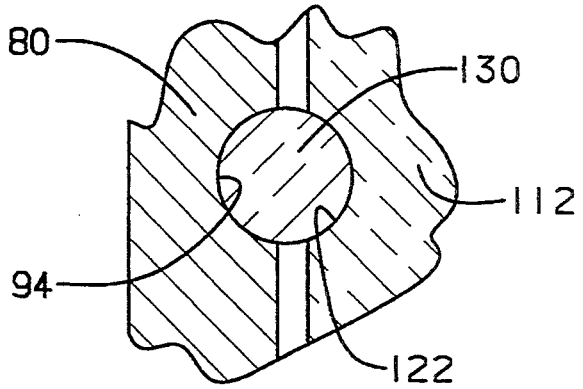
FIG. 4 is an enlarged sectional view of the grooves in the flanges and the blades having a generally "U" shaped configuration.

The turbine section 18 includes a power turbine 60 having an output shaft, not shown, connected thereto for driving an accessory component such as a generator. Another portion of the turbine section 18 includes a gas producer turbine 62 connected in driving relationship to the compressor section 16. The gas producer turbine 62 includes a turbine assembly 64 being rotationally positioned about the central axis 14. As best shown in FIGS. 2 and 3, the turbine assembly 64 includes a disc 66 being formed within an outer extremity 70. A plurality of threaded through holes 76, extend through the disc 66 and are positioned radially inwardly from the outer extremity a preestablished distance. The disc 66 is centered about the central axis 14 and, in this application, is made of an alloy steel and has a preestablished rate of thermal expansion.

A pair of cylindrical flanges 80 are positioned on either side of the disc 66. The pair of flanges 80, in this application, are made of an alloy steel and have a preestablished rate of thermal expansion being generally equal to the rate of thermal expansion of the disc 66. Each of the pair of flanges 80 has a preestablished thickness defined between an outer surface 82 and an inner surface 84. Each of the flanges 80 further include an outer generally cylindrical surface 86 having a preestablished diameter and an inner generally cylindrical surface 88 having a preestablished diameter. Intermediate the outer cylindrical surface 86 and the inner cylindrical surface 88 and extending through the thickness between the outer surface 82 and the inner surface 84 is a plurality of holes 90 corresponding to the plurality of through holes 76 in the disc 66. Each of the plurality of holes 90 include a recess 92. A pair of fasteners 93 are positioned in corresponding ones of the plurality of holes 90 in the flanges 80 and the plurality of holes 76 in the disc 66 attaching the flanges 80 to the disc 66. A plurality of grooves 94 are positioned within the inner surface 84 of each of the flanges 80. Each of the plurality of grooves 94 have a central axis 96, as shown in phantom in FIG. 2. The grooves 94 extend inwardly from the outer cylindrical surface 86 a preestablished distance. The central axis 96 of the grooves 94, when extended, intersects the central axis 14. Thus, the central axis 96 of the grooves 94 extend radially from the central axis 14; furthermore, the grooves 94 are generally evenly spaced about the circumference of the outer cylindrical surface 86 of the cylindrical flanges 80. Each of the grooves 94 has a bottom surface 98 which is spaced from the inner surface 84 a preestablished depth or distance and a pair of side walls 100, of which only one is shown in FIG. 3, equally spaced from the central axis 96 of the groove 94. Each of the grooves 94 is initiated from the outer cylindrical surface 86 radially inwardly toward the central axis 14 and has a radiused portion 104 extending from the bottom surface 98 intersecting with the inner surface 84. In this application, each of the grooves 94 has a generally "U" shaped configuration. However, as an alternative, each of the grooves 94 could have a generally "V" shaped or semicircular configuration without changing the essence of the invention. The intersection of the inner surface 84 and the outer cylindrical surface 86 has a chamfer 108 thereon. The inner surface 84 further includes a recessed portion 110 extending radially inwardly from the outer cylindrical portion 86 beyond each of the grooves 94.

The turbine assembly 64 further includes a plurality of blades 112 positioned intermediate the pair of flanges 80. Each of the blades 112 includes a root portion 116 generally confined between the pair of flanges 80, a base portion 118 extending radially outward from the root portion 116 and a blade portion 120 extending radially outward from the base portion 118. As an alternative, not shown, each of the blades 112 could have a plurality of blade portions 120 and a single root portion 116 and base portion 118. In this application, the blade 112 is made of a ceramic material, such as silicon carbide or silicon nitride, and has a preestablished rate of thermal expansion which is less than the preestablished rate of thermal expansion of the pair of flanges 80. The root portion 116 has a pair of sides 121 positioned adjacent the inner surfaces 84 of each of the flanges 80. A pair of grooves 122 are positioned in each of the pair of sides 121 of the blade 112. Each of the pair of grooves 122 has a central axis 124. Each of the grooves 122 extends outwardly through the root portion 116 and into the base portion 118. The central axis 124 of the grooves 122, when extended, intersects the central axis 14. Thus, the central axis 124 of the grooves 122 extend radially from the central axis 14; furthermore, the grooves 122 are evenly spaced on the blades 112 to align with the plurality of grooves 94 in the cylindrical flanges 80 when positioned in the turbine assembly 64. Each of the grooves 122 has a bottom 126 which is spaced from the pair of sides 121 a preestablished depth or distance and a pair of side walls 128 equally spaced from the central axis 124 of the grooves 122. In this application, each of the grooves 122 has a generally "U" shaped configuration. However, as an alternative, each of the grooves 122 could have a generally "V" shape or semicircular configuration without changing the essence of the invention. Furthermore, in this application, each of the grooves 94 in the flanges 80 and the grooves 122 in the blades 112 are of a generally similar configuration and size. As an alternative, each of the grooves 94 in the flanges 80 and the grooves 122 in the blades 112 could be of a different configuration and size.

In the assembled position, the pair of grooves 122 in each side of the blade 112 and a pair of the plurality of grooves 94 in the flanges 80 have their central axis 96,124 axially aligned respectively. Interposed the grooves 94 in the flanges 80 and grooves 122 in the blades 112 is a plurality of spherical balls 130. In this application, a pair of the spherical balls 130 are interposed the groves 122 in each of the pair of sides 121 of the blades 112 and the corresponding grooves 94 in the flanges 80. As an alternative, not shown, any number of spherical balls 130 such as three or four could be interposed in each of the corresponding grooves 94,122. In this application, each of the plurality of balls 130 is made of a ceramic material, such as silicon nitride or silicon carbide, having a preestablished rate of thermal expansion being substantially equal to that of the ceramic blade 112. The spherical balls 130 are formed by a preestablished radius of a size sufficient to substantially fill the space or void defined by the respective grooves 94,122 between the flanges 80 and the blade 112. As an alternative, the preestablished relationship of the spherical balls 130 could be slightly less than the space defined by the respective grooves 94,122 between the flanges 80 and the blade 112 without changing the essence of the invention.

The plurality of spherical balls 130 are positioned to correspond to the preestablished position of the respective grooves 94,122 between the flanges 80 and the blades 112 by a means for retaining 138. The means for retaining 138 includes a cage 140 having a generally washer type configuration defining an outer diameter 142 and an inner diameter 144. The cage 140 has an opening 146 having a generally elliptical shape interposed the outer diameter 142 and the inner diameter 144. In the assembled position, the cage 140 surrounds a pair of spherical balls 130. As an alternative, not shown, the plurality of openings 146 could have a round configuration.

INDUSTRIAL APPLICABILITY

In use, the gas turbine engine 10 is started and allowed to warm up and is used in any suitable power application. As the demand for load or power is increased, the engine 10 output is increased by increasing the fuel and subsequent air resulting in the temperature within the engine 10 increases. The components used to make up the turbine assembly 64, being of different materials and different rates of thermal expansion, grow at different rates and the forces resulting therefrom and acting thereon must structurally be compensated for to increase life and efficiency of the gas turbine engine. For example, as the turbine assembly 64 rotates, centrifugal forces cause the individual blades 112 to exert a force on the flanges 80 and the disc 66. For example, the force from the blades 112 are transmitted to the balls 130 and from the balls 130 to the flanges 80 into the fasteners 93 and into the disc 66. Since the grooves 94 in the flanges 80 and in the blades 112 extend radially from the central axis 14 of the gas turbine engine 10, the ceramic balls 130 exert a force on at least one of the pair of side walls 100 and the bottom surface 98 of the grooves 94 in the flanges 80 and a force on at least one of the pair of side walls 128 and the bottom 126 of the grooves 122 in the blades 112. The configuration of the grooves 94,122 and the spherical balls 130 permit the spherical balls 130 to roll along the mating surfaces as the blades 112 move due to the centrifugal force. Thus, the centrifugal forces transmitted from the blades 112 cause rolling contact between the flanges 80 and the balls 130 and the blade 112 and the balls 130 respectively. The load is reacted through the ceramic blade 112, into the ceramic spherical balls 130 and into the flanges 80 and the disc 66. The spherical balls 130 are placed under a highly compressive load which does not allow any surface flaw to propagate and cause catastrophic failure of the ceramic balls 130. As the flanges 80, which are made of an alloy steel material, expands due to an increase in temperature, the spherical balls 130 become in a further state of compression, however; the rolling contact is further utilized. For example, the relative geometry of the grooves 94 in the flanges 80 will grow to a greater degree relative to the geometry of the grooves 122 in the blades 112 and the spherical balls 130 which are made of a ceramic material. Thus, the spherical surface of the spherical balls 130 rotates about the contour of the grooves 94 in the flanges 80 and the grooves 122 in the blades 112. Thus, the centrifugal forces transmitted by the blades 112 results in rolling contact between the flanges 80 and the blade 112.

In view of the foregoing, it is readily apparent that the structure of the present invention provides an improved joint between the ceramic blade 112 or a component having a preestablished rate of thermal growth which is low and the turbine disc 66 and flanges 80 or a component having a preestablished rate of thermal growth which is much higher than the ceramic material. The structural arrangement of the spherical balls 130 and the mating surfaces of the grooves 94 in the flanges 80 and the grooves 122 in the blades 112 provides a rolling joint which reduces or eliminates surface induced flaws which may cause catastrophic failure of ceramic components.

Other aspects, objects and advantages of this invention can be obtained from a study of the drawings, the disclosure and the appended claims.

I claim:

1. A turbine assembly being centered about a central axis, said turbine assembly comprising:

a turbine disc having an outer cylindrical surface;

a pair of flanges being attached to the disc and having a portion thereof extending beyond the outer cylindrical surface of the turbine disc, each of said pair of flanges defining an outer cylindrical surface and an inner surface having a plurality of radially extending grooves positioned therein, each of said plurality of grooves defining a central axis evenly spaced about the circumference of the outer cylindrical surface of each of the pair of flanges and extending radially to intersect the central axis about which the turbine assembly is centered;

a plurality of blades being attached within the flanges, each of said plurality of blades having a root portion confined within the pair of flanges, said root portion having a pair of sides each having a pair of radially extending grooves defined therein, said pair of grooves defining a central axis extending radially to intersect with the central axis about which the turbine assembly is centered;

said grooves within the blades being aligned with respective ones of the plurality of grooves within the flanges; and a plurality of spherical balls positioned within the grooves within the flanges and the grooves within the blades.

2. The turbine assembly of claim 1 wherein each of said plurality of radially extending grooves being positioned radially outwardly of the outer cylindrical surface of the disc.

3. The turbine assembly of claim 2 wherein each of said plurality of blades further includes a base portion extending from the root portion, said grooves extending into the base portion.

4. The turbine assembly of claim 1 wherein said groove within each of the blades has a configuration being defined by a "U" shape.

5. The turbine assembly of claim 1 wherein said grooves within the pair of flanges have a configuration being defined by a "U" shape.

6. The turbine assembly of claim 1 wherein said disc is centered about a central axis and said grooves within the flanges have a central axis extending radially from the central axis of the disc.

7. The turbine assembly of claim 1 wherein said turbine disc and said pair of flanges are made of a material having a preestablished rate of thermal expansion and each of said plurality of blades is made of a material having a preestablished rate of thermal expansion being less than the preestablished rate of thermal expansion of the turbine disc and the pair of flanges.

8. The turbine assembly of claim 7 wherein each of said plurality of balls is made of a material having a preestablished rate of thermal expansion being substantially equal to the preestablished rate of thermal expansion of each of the plurality of blades.

9. The turbine assembly of claim 1 wherein said spherical balls are in rolling relationship to the blades.

* * * * *